US008925141B2

(12) United States Patent
Kim et al.

(10) Patent No.: US 8,925,141 B2
(45) Date of Patent: Jan. 6, 2015

(54) VACUUM CLEANER HAVING STERILIZATION FUNCTION

(75) Inventors: Min-ha Kim, Gwangju (KR); Joung-soo Park, Jeonju-si (KR); Sung-tae Joo, Gwangju (KR); Hyun-ju Lee, Gwangju (KR); Dong-houn Yang, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 777 days.

(21) Appl. No.: 13/166,705

(22) Filed: Jun. 22, 2011

(65) Prior Publication Data

US 2012/0096670 A1 Apr. 26, 2012

(30) Foreign Application Priority Data

Oct. 22, 2010 (KR) ..... 2010-0103612

(51) Int. Cl.

| | |
|---|---|
| ***A47L 9/02*** | (2006.01) |
| ***A47L 9/04*** | (2006.01) |
| ***A47L 9/16*** | (2006.01) |
| ***A47L 7/00*** | (2006.01) |

(52) U.S. Cl.

CPC ..... *A47L 9/0477* (2013.01); *A47L 9/02* (2013.01); *A47L 9/0416* (2013.01); *A47L 9/1658* (2013.01); *A47L 7/0061* (2013.01)

USPC ..... 15/320; 15/322; 15/339; 15/415.1

(58) Field of Classification Search

CPC ..... A47L 7/04; A47L 9/02

USPC ..... 15/320, 322, 339, 415.1

IPC ..... A47L 9/02

See application file for complete search history.

(56) References Cited

U.S. PATENT DOCUMENTS

2010/0306953 A1* 12/2010 Chan ..... 15/339
2012/0246863 A1* 10/2012 Douglas ..... 15/339

FOREIGN PATENT DOCUMENTS

JP 2010-104831 A 5/2010

OTHER PUBLICATIONS

Korean Notice of Preliminary Rejection dated Jul. 23, 2012, issued in counterpart Korean Patent Application No. 10-2010-0103612; 9 pages including English translation.

* cited by examiner

*Primary Examiner* — David Redding
(74) *Attorney, Agent, or Firm* — NSIP Law

(57) ABSTRACT

A suction nozzle for use in a vacuum cleaner includes a suction opening through which air is drawn in from a surface to be cleaned, a sterilization chamber having at least one inlet and at least one outlet, the sterilization chamber being in fluid communication with the suction opening through the at least one inlet, and a sterilization unit disposed in the sterilization chamber to sterilize the air drawn into the sterilization chamber. The air drawn into the sterilization chamber revolves while moving from the at least one inlet to the at least one outlet.

25 Claims, 8 Drawing Sheets

VACUUM CLEANER HAVING STERILIZATION FUNCTION

CROSS-REFERENCE TO RELATED APPLICATIONS

This application claims the benefit under 35 U.S.C. §119(a) of a Korean Patent Application No. 10-2010-0103612, filed on Oct. 22, 2010, in the Korean Intellectual Property Office, the entire disclosure of which is incorporated herein by reference for all purposes.

BACKGROUND

1. Field

The following description relates to a vacuum cleaner. More specifically, the following description relates to a vacuum cleaner having a sterilization function.

2. Description of Related Art

A vacuum cleaner may draw in and store dust or dirt from a surface to be cleaned by using a suction force generated a vacuum source, for example, a suction motor.

A vacuum cleaner may sterilize germs or mites existing on a surface to be cleaned while cleaning the surface. Such a vacuum cleaner typically radiates ultraviolet rays onto the surface to be cleaned with an ultraviolet lamp mounted in a suction nozzle (or a suction brush), thereby sterilizing the surface to be cleaned.

When the vacuum cleaner is used, the faster the suction nozzle is moved with respect to the surface to be cleaned, the less the ultraviolet rays are radiated onto the surface to be cleaned. That is, the faster the suction nozzle is moved relative the surface, the shorter amount of time the ultraviolet rays are radiated onto a particular portion of the surface. If a sufficient amount of ultraviolet rays is not radiated to the surface to be cleaned, the surface to be cleaned may be poorly sterilized. To obtain a satisfactory sterilization effect, a user should move the suction nozzle at a relatively low speed while cleaning up the surface to be cleaned.

In this case, the time required to clean and sterilize the surface to be cleaned is increased, which may be inconvenient to the user. In addition, it may be difficult or uncomfortable for the user to operate the vacuum cleaner for the increased amount of time it takes to sufficiently sterilize the surface to be cleaned.

SUMMARY

In one general aspect there is provided a suction nozzle for use in a vacuum cleaner, the suction nozzle including a suction opening through which an air is drawn in from a surface to be cleaned, a sterilization chamber having at least one inlet and at least one outlet, the sterilization chamber being in fluid communication with the suction opening through the at least one inlet, and a first suction nozzle sterilization unit disposed in the sterilization chamber to sterilize the air drawn into the sterilization chamber. The air drawn into the sterilization chamber revolves while moving from the at least one inlet to the at least one outlet The sterilization chamber may have a cylindrical shape.

The suction nozzle may further include a guide channel to guide the air drawn in through the suction opening, into the at least one inlet.

The guide channel may be disposed in a tangential direction with respect to the sterilization chamber.

The at least one inlet and the at least one outlet may be spaced apart from each other in a central axis direction of the sterilization chamber.

The sterilization chamber may include a first sterilization chamber having a first inlet and a first outlet, the first sterilization chamber being in fluid communication with the suction opening through the first inlet, and a second sterilization chamber having a second inlet and a second outlet, the second sterilization chamber being in fluid communication with the suction opening through the second inlet.

The first and the second sterilization chambers may be in the form of a cylinder, and have the same central axis.

The suction nozzle may further include a first guide channel to guide the air drawn in through the suction opening, into the first inlet and a second guide channel to guide the air drawn in through the suction opening, into the second inlet. The first and the second guide channels may be disposed in a tangential direction with respect to the first and the second sterilization chambers in the form of the cylinder.

The first inlet and the first outlet may be spaced apart from each other in a central axis direction of the first sterilization chamber and the second inlet and the second outlet may be spaced apart from each other in a central axis direction of the second sterilization chamber.

The first and the second outlets may be in fluid communication with each other.

The first suction nozzle sterilization unit may be disposed in a central part of the sterilization chamber.

The first suction nozzle sterilization unit may have a cylindrical shape and may be extended along a central axis of the sterilization chamber.

The first suction nozzle sterilization unit may be disposed adjacent to a chamber wall forming the sterilization chamber.

The chamber wall may have a plurality of mounting grooves projected outside from the chamber wall and extended in a width direction of the suction nozzle, and a plurality of sterilization units may be mounted in the plurality of mounting grooves, respectively.

The plurality of mounting grooves may be disposed at regular intervals.

The first suction nozzle sterilization unit may have a ring shape, and may be disposed on the chamber wall.

The first suction nozzle sterilization unit may include a plurality of sterilization units and the plurality of sterilization units may be disposed at regular intervals along a width direction of the suction nozzle.

A second suction nozzle sterilization unit may be additionally disposed in a bottom casing of the suction nozzle.

The suction nozzle may further include a drum brush to separate a dirt or dust from the surface to be cleaned, the drum brush having furs on which an antimicrobial is coated.

The antimicrobial may include a nano-silver.

The first suction nozzle sterilization unit may include one of an ultraviolet lamp, a heater and an ozonizer.

The suction nozzle may further include more than one transparent window capable of observing the sterilization chamber from the outside.

In another aspect, there is provided a vacuum cleaner including a main body to generate a suction force and a suction nozzle to draw in a dust or dirt from a surface to be cleaned by using the suction force. The suction nozzle includes a suction opening through which an air is drawn in along with the dirt or dust from the surface to be cleaned, a sterilization chamber having at least one inlet and at least one outlet, the sterilization chamber being in fluid communication with the suction opening through the at least one inlet, and a first suction nozzle sterilization unit disposed in the sterilization chamber to sterilize the air drawn into the sterilization chamber. The air drawn into the sterilization chamber revolves while moving from the at least one inlet to the at least one outlet.

In another aspect, there is provided a dust separating apparatus for use in a vacuum cleaner including a cyclone chamber to separate a dust or dirt from an air drawn in from a surface to be cleaned, by using a centrifugal force and a sterilization unit disposed in the cyclone chamber to sterilize the air drawn into the cyclone chamber. The air drawn into the cyclone chamber revolves while moving from an inlet of the dust separating apparatus to an outlet of the dust separating apparatus.

The sterilization unit may be extended along a central axis of the cyclone chamber.

The sterilization unit may include one of an ultraviolet lamp, a heater and an ozonizer.

In still another aspect, there is provided a vacuum cleaner including a suction nozzle to draw in a dust or dirt from a surface to be cleaned and a dust separating apparatus to separate the dust or dirt from the drawn-in air. The dust separating apparatus includes a cyclone chamber to separate the dust or dirt from an air drawn in from a surface to be cleaned, by using a centrifugal force, and a sterilization unit disposed in the cyclone chamber to sterilize the air drawn into the cyclone chamber. The air drawn into the cyclone chamber revolves while moving from an inlet of the dust separating apparatus to an outlet of the dust separating apparatus.

In another aspect, there is provided a vacuum cleaner including a main body to generate a suction force, the main body including a dust separating apparatus, a suction nozzle, connected to the main body, to draw in air along with dust or dirt from a surface to be cleaned, the suction nozzle including a sterilization chamber, and a sterilization unit disposed in at least one of the sterilization chamber and dust separating apparatus to sterilize air drawn into the vacuum cleaner by the suction nozzle.

Other features and aspects will be apparent from the following detailed description, the drawings and the claims.

Figure 1:
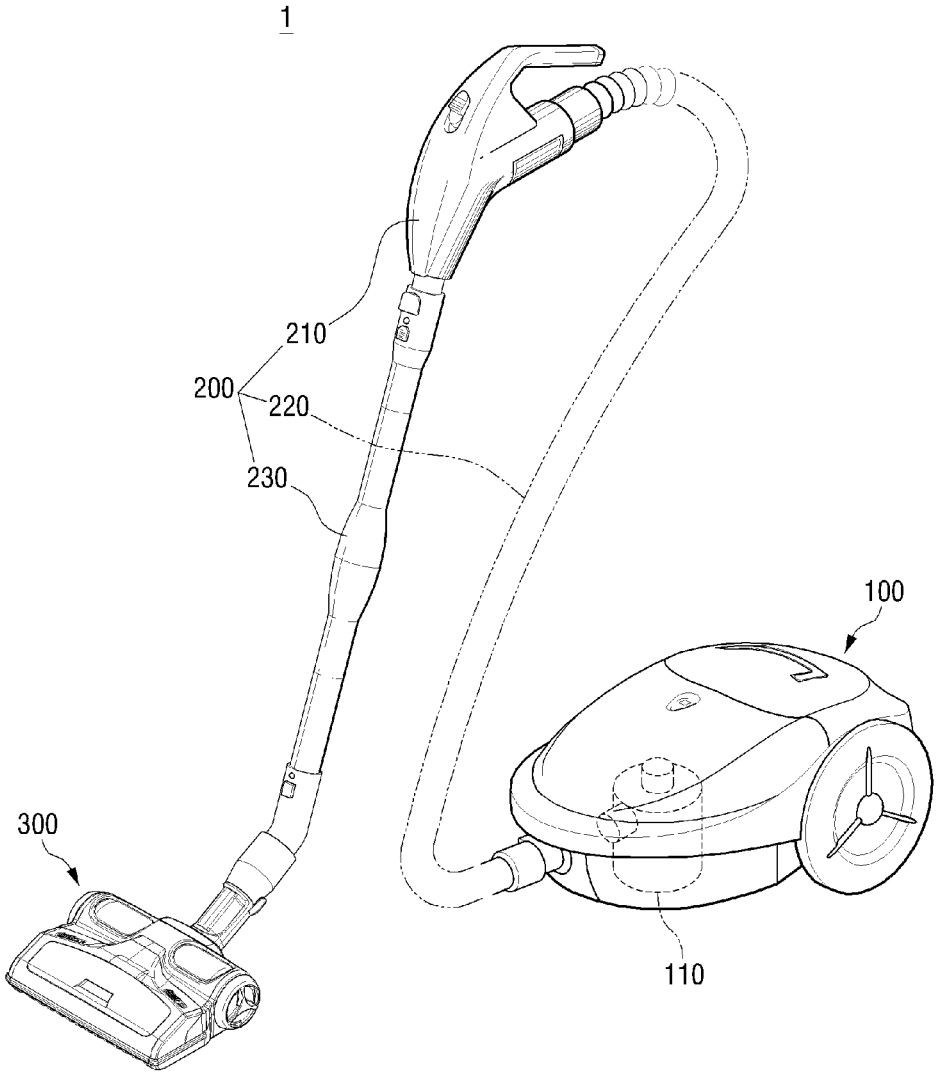
FIG. 1 is a perspective view illustrating an example of a vacuum cleaner.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

FIG. 1 is a perspective view illustrating an example of a vacuum cleaner 1.

Referring to FIG. 1, the vacuum cleaner 1 includes a main body 100, a connecting part 200 and a suction nozzle 300.

The main body 100 may generate a suction force to draw in air, and separate and store a dust or dirt from the drawn-in air. For this, a suction motor (not shown) to generate the suction force and a dust separating apparatus 110 to separate and store the dust or dirt from the drawn-in air are contained in the main body 100.

The connecting part 200 connects the suction nozzle 300 with the main body 100 and guides the air drawn in by the suction nozzle 300 into the main body 100. The connecting part 200 includes a handle 210 capable of being gripped by a user, a suction hose 220 made of a flexible material to connect the handle 210 with the main body 100, and an extended pipe 230 to connect the handle 210 with the suction nozzle 300.

The suction nozzle 300 may draw in dust or dirt from a surface to be cleaned by using the suction force provided from the main body 100. The suction nozzle 300 is explained further with reference to FIGS. 2 to 4.

Figure 2:
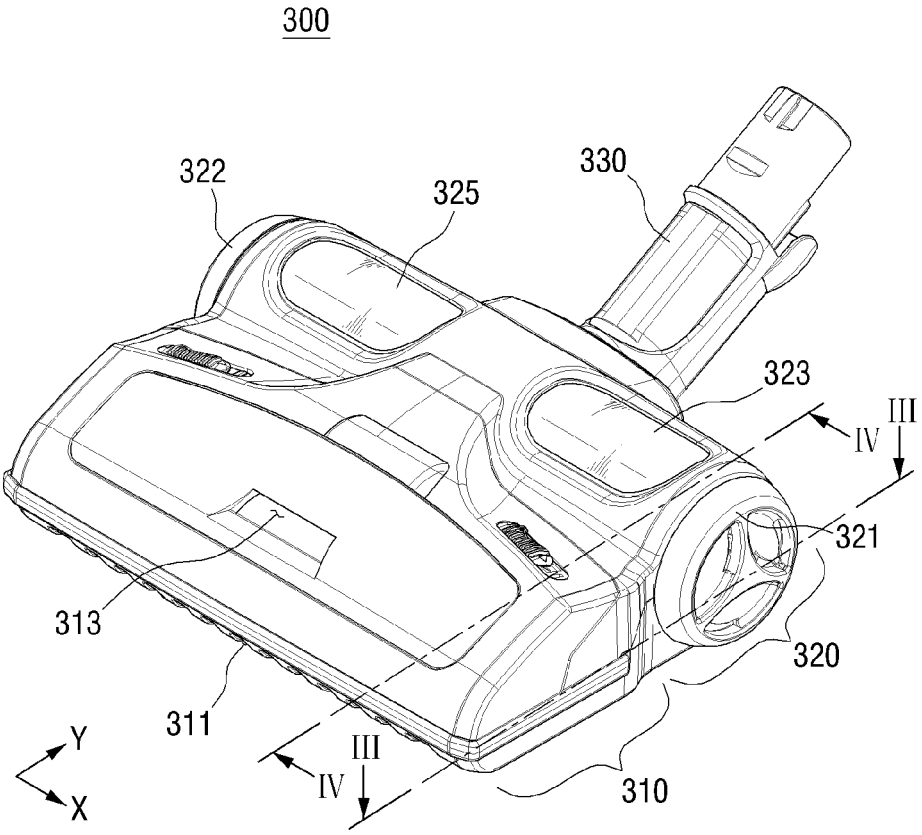
FIG. 2 is a perspective view illustrating an example of a suction nozzle provided in the vacuum cleaner shown in FIG. 1.
Figure 3:
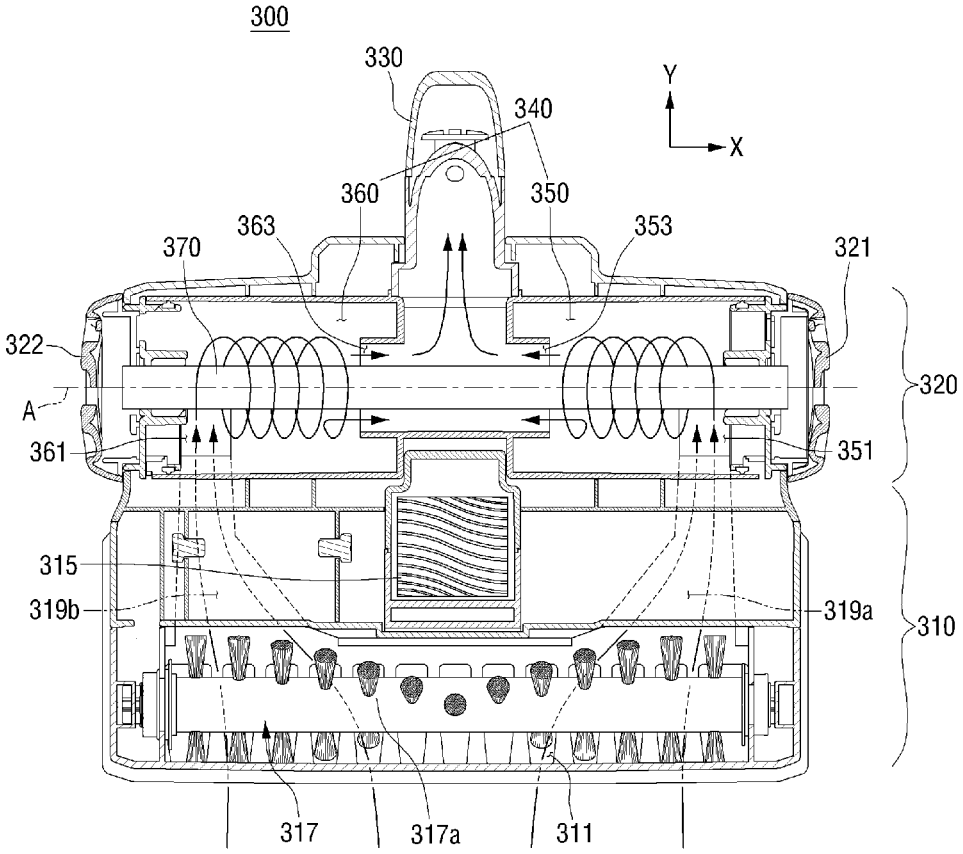
FIG. 3 is a cross sectional view illustrating an example of the suction nozzle taken along line III-III of FIG. 2.
Figure 4:
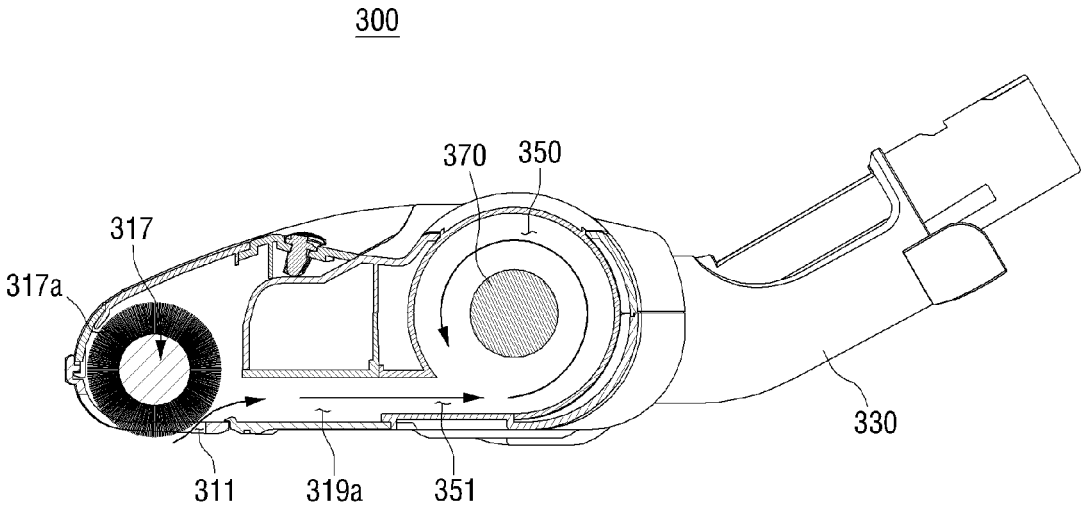
FIG. 4 is a cross sectional view illustrating an example of the suction nozzle taken along line IV-IV of FIG. 2.

FIG. 2 is a perspective view illustrating an example of a suction nozzle provided in the vacuum cleaner shown in FIG. 1. FIG. 3 is a cross sectional view illustrating an example of the suction nozzle taken along line III-III of FIG. 2. FIG. 4 is a cross sectional view illustrating an example of the suction nozzle taken along line IV-IV of FIG. 2.

Referring to the examples shown in FIGS. 2 to 4, the suction nozzle 300 includes a suction part 310 to draw in the dust or dirt along with the outer air, a sterilization part 320 to sterilize the drawn-in air, and a coupling part 330 coupled to the extended pipe 230 (see FIG. 1).

Referring to FIG. 2, a plurality of suction openings 311 and an air inflow hole 313 are formed in the suction part 310. The plurality of suction openings 311 are arranged along a width direction (that is, along the X direction shown in FIG. 2) of the suction nozzle 300 and face the surface to be cleaned. Through these suction openings 311, the dust or dirt on the surface to be cleaned may be drawn into the suction nozzle 300. The air inflow hole 313 may be formed in an upper side of the suction part 310 and is opened toward the front of the suction nozzle 300. A portion of the suction force may be applied on the air inflow hole 313, and thus an outer air may be drawn into the suction nozzle 300 through the air inflow hole 313 in addition to the suction openings 311.

Referring to FIG. 3, a driving fan 315 and a drum brush 317 are mounted in the suction part 310. The driving fan 315 may be rotated by the air drawn in through the air inflow hole 313 as described above, so that a rotary force thereof may be transmitted to the drum brush 317 through a driving belt (not shown). The drum brush 317 is in the form of a cylinder and has a plurality of drum furs 317*a* provided on an outer surface thereof. During a cleaning operation, the drum brush 317 is rotated by the rotary force transmitted from the driving fan 315, and at this time, the drum furs 317*a* of the drum brush 317 may strike the surface to be cleaned to separate the dust or dirt adhered to the surface.

Referring to FIG. 3, the sterilization part 320 includes a sterilization chamber 340, and a first suction nozzle sterilization unit 370.

The sterilization chamber 340 includes a first sterilization chamber 350 and a second sterilization chamber 360.

The first sterilization chamber 350 may have a cylindrical shape. The first sterilization chamber 350 extends along the width direction (the direction of X) of the suction nozzle 300. In other words, a central axis A of the first sterilization chamber 350 is disposed along the direction of X. A first inlet 351 is formed on one side of the first sterilization chamber 350. The first inlet 351 is in fluid communication with the suction openings 311 through a first guide channel 319*a*. Accordingly, a portion of the air drawn into the suction nozzle 300 through the suction openings 311 may flow into the first sterilization chamber 350 via the first guide channel 319*a* and the first inlet 351. The first inlet 351 may guide the drawn-in air in a tangential direction with respect to the first sterilization chamber 350, thereby enabling the drawn-in air to form a whirling air current in the first sterilization chamber 350. On the other side of the first sterilization chamber 350 therein is formed a first outlet 353, which is spaced apart from the first inlet 351 in the direction of X. In this way, the air drawn into the first sterilization chamber 350 may make a spiral motion while moving from the first inlet 351 to the first outlet 353. The air, which is sterilized in the first sterilization chamber 350, exits the first sterilization chamber 350 through the first outlet 353.

The first and the second sterilization chambers 350 and 360 have a similar structure. Accordingly, like the first sterilization chamber 350, the second sterilization chamber 360 may have a cylindrical shape, and is extended along the width direction (the direction of X) of the suction nozzle 300. In addition, the second sterilization chamber 360 has a second inlet 361 and a second outlet 363, which are spaced apart from each other in the direction of X. The second inlet 361 is in fluid communication with the suction openings 311 through a second guide channel 319*b*. Accordingly, a portion of the air drawn into the suction nozzle 300 through the suction openings 311 may flow into the second sterilization chamber 360 via the second guide channel 319*b* and the second inlet 361. The second inlet 361 may guide the drawn-in air in a tangential direction with respect to the second sterilization chamber 360, thereby enabling the drawn-in air to form a whirling air current in the second sterilization chamber 360. In other words, the air flowed into the second sterilization chamber 360 may make a spiral motion while moving from the second inlet 361 to the second outlet 363. The air, which is sterilized in the second sterilization chamber 360, exits the second sterilization chamber 360 through the second outlet 363.

The first and the second sterilization chambers 350 and 360 have the same central axis A. In other words, the first and the second sterilization chambers are arranged in series to be symmetric with respect to a virtual straight line passing through the coupling part 330. As shown in FIG. 2, to see through the first and the second sterilization chambers 350 and 360 from the outside, transparent windows 323 and 325 are provided in the sterilization part 320. Accordingly, a user may observe operating conditions in the first and the second sterilization chambers 350 and 360 through the transparent windows 323 and 325.

The first suction nozzle sterilization unit, as used in this application, may generally refer to a sterilization unit disposed in or around the sterilization chamber of the suction nozzle. In the example of FIGS. 3 and 4, the first suction nozzle sterilization unit 370 is disposed in a center part of the sterilization chamber 340, including the first sterilization chamber 350 and the second sterilization chamber 360. A pair of mounting members 321 and 322 in which the first suction nozzle sterilization unit 370 is inserted and fixed is provided in the sterilization part 320 of the suction nozzle 300. The first suction nozzle sterilization unit 370 may have a cylindrical shape and is disposed along central axis A extending through the sterilization chambers 350 and 360. The first suction nozzle sterilization unit 370 may include an ultraviolet (UV) lamp. Thus germs and mites included the drawn-in air may be sterilized by ultraviolet rays radiated or emitted from the first suction nozzle sterilization unit 370. In alternative examples, the first suction nozzle sterilization unit 370 may be made up of a heater or an ozonizer, which radiates a heat or an ozone for sterilization.

Hereinafter, an example of a sterilization process, which is carried out in the suction nozzle 300, is explained with reference to FIGS. 3 and 4.

If the user cleans the surface to be cleaned by using the vacuum cleaner 1 examples described herein, a portion of an air drawn in from the surface to be cleaned through the suction openings 311 flows into the first sterilization chamber 350 through the first guide channel 319*a* and the first inlet 351, and another portion of the drawn-in air flows into the second sterilization chamber 360 through the second guide channel 319*b* and the second inlet 361.

As shown in FIG. 4, the first guide channel 319*a* is disposed in a tangential direction with respect to the first sterilization chamber 350 in the form of the cylinder. Similarly, the second guide channel 319*b* is also disposed in a tangential direction with respect to the second sterilization chamber 360 in the form of the cylinder. Accordingly, the drawn-in air may flow into the sterilization chambers 350 and 360 in the form of the cylinder in the tangential direction. As a result, the air flowed into the sterilization chambers 350 and 360 may have a motion of revolving around the first suction nozzle sterilization unit 370. Due to the suction force applied on the outlets 353 and 363, the air in the sterilization chambers 350 and 360 has a motion of moving from the inlets 351 and 361 to the outlets 353 and 363. Consequently, the air may spirally flow about the first suction nozzle sterilization unit 370 in the sterilization chambers 350 and 360.

Like this, the air flowed into the sterilization chambers 350 and 360 forms an air flow moving from the inlets 351 and 361 to the outlets 353 and 363 while revolving around the first suction nozzle sterilization unit 370. Because the air in the sterilization chamber 350 and 360 has the rotary motion as described above, a time that the air stays in the sterilization chamber 350 and 360 may be prolonged relative to a scenario when the air does not have any rotary motion. Accordingly, the amount of time the ultraviolet may be radiated onto the air in the sterilization chambers may be increased. Thus, sterilization to the air in the sterilization chambers 350 and 360 may be sufficiently achieved.

The air, which is sterilized in the sterilization chambers 350 and 360, exits the sterilization chambers 350 and 360 through the outlets 353 and 363 and then is discharged from the suction nozzle 300 through the coupling part 330.

Referring again to FIG. 1, the air discharged from the suction nozzle 300 flows into the main body 100 via the connecting part 200. As described above, the dust separating apparatus 110 for separating and storing the dust or dirt is positioned in the main body 100. The dust separating apparatus 110 is explained below with reference to FIG. 5.

Figure 5:
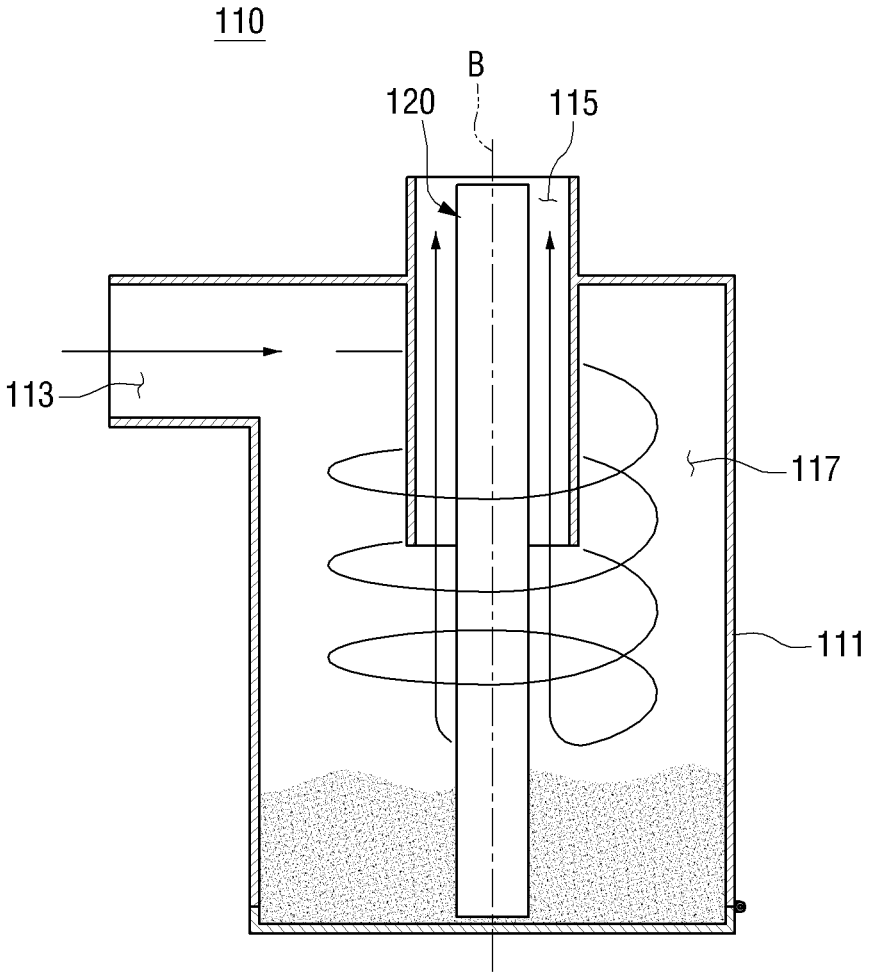
FIG. 5 is a schematic cross sectional view illustrating an example of a dust separating apparatus provided in a main body of the vacuum cleaner shown in FIG. 1.

FIG. 5 is a schematic cross sectional view of an example of the dust separating apparatus 110 provided in the main body 100 of the vacuum cleaner 1 shown in FIG. 1.

Referring to the example in FIG. 5, the dust separating apparatus 110 is made up of a cyclone dust separating apparatus. According to this, the dust separating apparatus 110 includes a dust separating bin 111, an inlet 113 and outlet 115. A cyclone chamber 117 is defined in the dust separating bin 111. The drawn-in air that flows into the cyclone chamber 117 through the inlet 113 is moved down while revolving and then moved up to exit the cyclone chamber 117 through the outlet 115 by the suction force of the suction motor.

This dust separating apparatus 110 is also provided with a main body sterilization unit 120. As shown in FIG. 5, the main body sterilization unit 120 is vertically disposed in a center part of the cyclone chamber 117, and extended along a central axis B of the cyclone chamber 117. Like the first suction nozzle sterilization unit 370, positioned in the suction nozzle 300, as described above, the main body sterilization unit 120 may be made up of an ultraviolet lamp. In an alternative example, the main body sterilization unit 120 may be made up of a heater.

With such a main body sterilization unit 120, the drawn-in air may be sterilized in the dust separating apparatus 110. Also, because the drawn-in air is revolved in the dust separating apparatus 110, the air drawn into the dust separating apparatus 110 may stay in the dust separating apparatus 110 for a period of time sufficient to be sterilized. Accordingly, sterilization to the drawn-in air in the cyclone chamber 117 may be sufficiently achieved.

The air, sterilized in the cyclone chamber 117, exits the dust separating apparatus 110 through the outlet 115 and is then discharged out of the main body 100 via the suction motor. Because the drawn-in air may be sterilized in the suction nozzle 300 and the dust separating apparatus 110 prior to being discharged from the main body 100, the air discharged out of the main body 100 comes to a state where the germs and the mites may be sterilized.

In the vacuum cleaner 1 described above, the suction nozzle 300 and the dust separating apparatus 110 are provided with the first suction nozzle and main body sterilization units 370 and 120, respectively. However, such an arrangement is described only as an example. In alternative examples, a sterilization unit may be disposed only in either the suction nozzle or the dust separating apparatus.

Hereinafter, suction nozzles according to other examples are explained with reference to FIGS. 6 to 8. Constructions and characteristics, which are common to the suction nozzle 300 (see FIG. 4) according to the example described above are not repeatedly described, but omitted.

Figure 6:
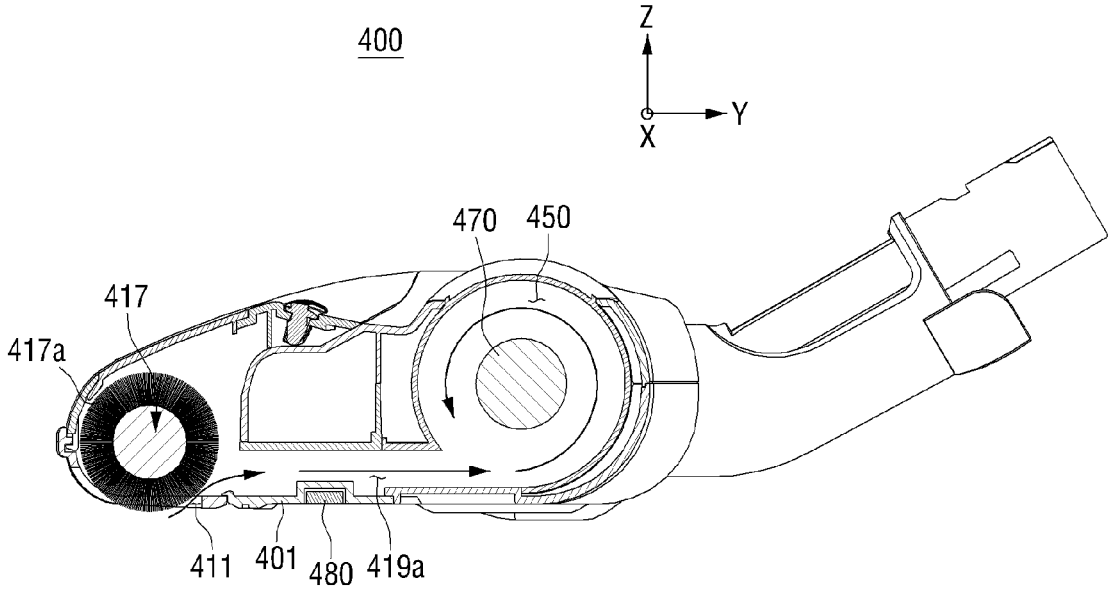
FIG. 6 is a longitudinal section view illustrating a second example of a suction nozzle.

FIG. 6 is a longitudinal section view of a second example of a suction nozzle 400.

Referring to FIG. 6, the suction nozzle 400 of the second example may be distinguished from the suction nozzle of the first example described above in that it further includes a second suction nozzle sterilization unit 480 disposed on a bottom casing 401 thereof. The second suction nozzle sterilization unit 480 is extended side by side with a drum brush 417 in a width direction (a direction of X) of the suction nozzle 400. As shown in the example of FIG. 6, the second suction nozzle sterilization unit 480 has a rectangular cross section. However, this is shown for the purposes of example only, and the cross-section of the second suction nozzle sterilization unit 480 is not limited thereto. For example, the second suction nozzle sterilization unit may have other types of cross sections, such as a circle, an oval, etc.

Like the example of the first suction nozzle sterilization unit 470 provided in the sterilization chamber 450, the second suction nozzle sterilization unit 480 may be made up of an ultraviolet lamp. Accordingly, harmful microorganisms, such as germs, mites and the like, on the surface to be cleaned may be sterilized by ultraviolet rays emitted from the second suction nozzle sterilization unit 480. The second suction nozzle sterilization unit 480 is not limited to an ultraviolet lamp. For example, the second suction nozzle sterilization unit 480 may be made up of a heater or an ozonizer, which radiates a heat or an ozone for sterilization.

According to the second example of suction nozzle 400 described above, a primary sterilization is performed by the second suction nozzle sterilization unit 480 provided on the bottom casing 401, and a secondary sterilization is performed by the first suction nozzle sterilization unit 470 mounted in a sterilization chamber 450 inside the suction nozzle 400. As described above, because the sterilization process is doubly performed, the second example of the suction nozzle 400 may provide improved sterilization performance.

In one alternative to the second example described above, an antimicrobial, such as a nano-silver or the like, may be coated on drum furs 417*a* of the drum brush 417, instead of providing the second suction nozzle sterilization unit 480 on the bottom casing 401 of the suction nozzle 400 as shown in FIG. 6. The antimicrobial may exist at uniform densities on the drum furs 417*a*, or intensively exist on outer side ends of the drum furs 417*a* coming in contact with the surface to be cleaned.

According to this example, a primary sterilization is performed by the antimicrobial coated on the drum furs 417*a*, and a secondary sterilization is performed by the first suction nozzle sterilization unit 470 mounted in the sterilization chamber 450 inside the suction nozzle 400. Accordingly, an improved sterilization performance may be obtained.

In another alternative to the second example described above, the second suction nozzle sterilization unit 480 may be additionally provided on the bottom casing 401 as shown in FIG. 6 and at the same time, an antimicrobial, such as a nano-silver or the like, may be coated on the drum furs 417*a* of the drum brush 417. According to this alternative, because the sterilization process is doubly performed by the sterilization unit 480 provided on the bottom casing 401 and the antimicrobial on the drum furs 417*a* in advance of being performed by the first suction nozzle sterilization unit 470 in the sterilization chamber 450, the sterilization performance may be improved.

Figure 7:
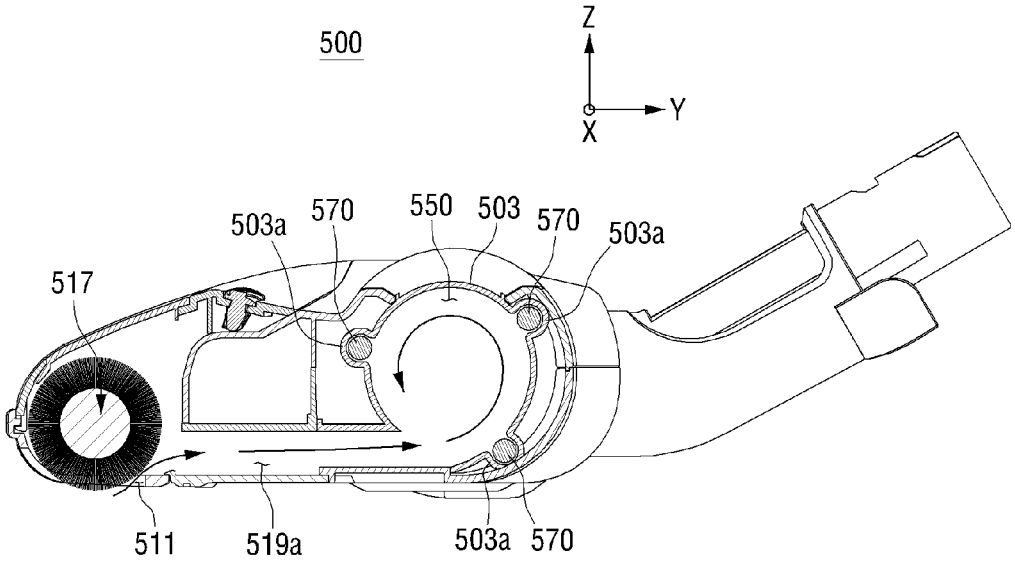
FIG. 7 is a longitudinal section view illustrating a third example of a suction nozzle.

FIG. 7 is a longitudinal section view of a third example of suction nozzle 500.

Referring to the example in FIG. 7, the suction nozzle 500 may be distinguished from the suction nozzle 300 of the first example described above in that a first suction nozzle sterilization unit includes a plurality of sterilization units 570 is disposed around a sterilization chamber 550.

Three mounting grooves 503*a* are formed at regular intervals in a chamber wall 503 forming the sterilization chamber 550, and projected outside therefrom. These mounting grooves 503*a* are extended along a width direction (a direction of X) of the suction nozzle 500. The sterilization units of the plurality of sterilization units 570 are mounted in these mounting grooves 503*a*, respectively. Like the mounting grooves 503*a*, the sterilization units 570 are also extended along the width direction of the suction nozzle 500, and disposed at regular intervals. Although the mounting grooves 503*a* and the sterilization units 570 are illustrated as being composed of three mounting grooves 503*a* and three sterilization units 570, respectively, this example is not limited thereto. For example, the number of the mounting grooves 503*a* and the sterilization units 570 may be varied to, for example, 2, 4, 5, or other suitable number.

These sterilization units 570 may be made up of ultraviolet lamps. Accordingly, harmful microorganisms, such as germs, mites and the like, existing in the air drawn into the sterilization chamber 550 may be sterilized by ultraviolet rays emitted from the sterilization units 570. Alternatively, the sterilization units 570 may be made up of heaters or ozonizers, which radiate a heat or an ozone for sterilization.

Figure 8:
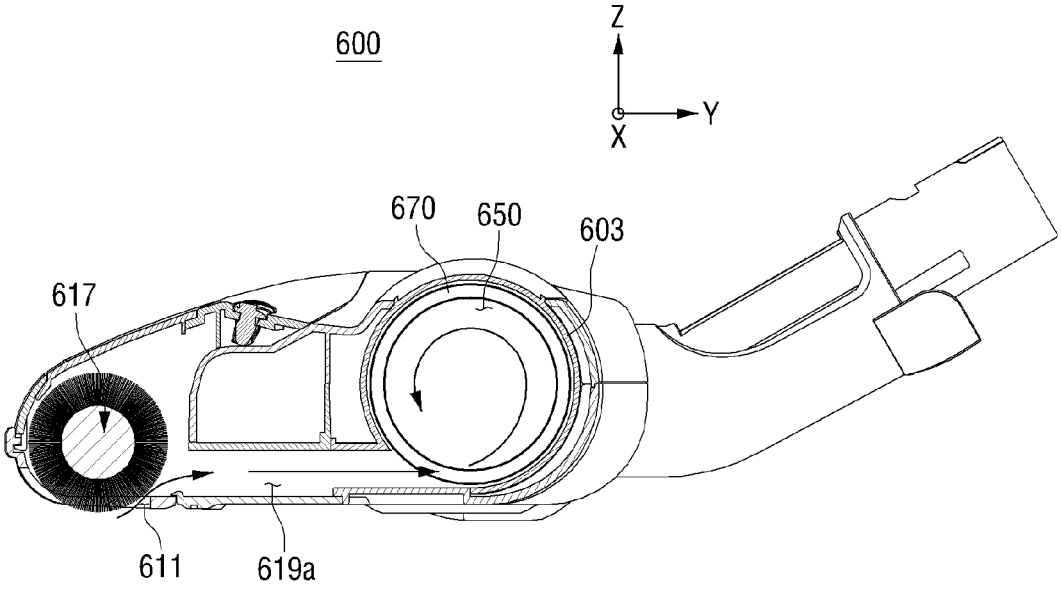
FIG. 8 is a longitudinal section view illustrating a fourth example of a suction nozzle.

FIG. 8 is a longitudinal section view of a fourth example of a suction nozzle 600.

Referring to FIG. 8, the suction nozzle 600 of the fourth example may be distinguished from the suction nozzle 300 of the first example described above in that in a sterilization chamber 650, the first suction nozzle sterilization unit includes a plurality of sterilization units 670 in the form of a ring is disposed, instead of the single sterilization unit in the form of the cylinder.

In this example, the plurality of (for example, two, tour, six, etc;) sterilization units 670 is disposed along a width direction (a direction of X) of the suction nozzle 600. The sterilization units 670 may be disposed at regular intervals. Each of the sterilization units 670 in the form of the ring is disposed adjacent to a chamber wall 603, and is extended in a circumferential direction of the sterilization chamber 650. Alternatively, the sterilization units 670 may be disposed in a spiral shape on the chamber wall 603.

These sterilization units 670 may be made up of ultraviolet lamps. Accordingly, harmful microorganisms, such as germs, mites and the like, existing in the air drawn into the sterilization chamber 650 may be sterilized by an ultraviolet emitted from the sterilization units 670. Alternatively, the sterilization units 670 may be made up of heaters or ozonizers, which radiate a heat or an ozone for sterilization.

As explained above, the suction nozzle and/or the dust separating apparatus is provided with the sterilization features, so that harmful microorganisms, such as germs, mites and the like, existing on a surface to be cleaned may be sterilized.

Further, the drawn-in air may be spirally flowed for a certain time in the sterilization chamber of the suction nozzle and the cyclone chamber of the dust separating apparatus and then discharged therefrom, thereby allowing the air to come in contact with sterilization media (the ultraviolet, the heat or the ozone) radiated from the sterilization units in the chambers for a sufficient amount of time. Accordingly, the vacuum cleaner of the present application may present improved sterilization performance, as compared with the conventional vacuum cleaner, which supplies the sterilization media directly to the surface to be cleaned.

Also, according to the present application, the sterilization unit mounted on the bottom casing of the suction nozzle and/or the antimicrobial coated on the furs of the drum brush may be additionally provided, thereby allowing the sterilization to be further conducted on the bottom casing and/or the furs of the drum brush in addition to in the sterilization chamber of the suction nozzle. According to this, the vacuum cleaner of the present application may have further improved sterilization performance.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A suction nozzle for use in a vacuum cleaner, the suction nozzle comprising:

a suction opening through which an air is drawn in from a surface to be cleaned;

a sterilization chamber having at least one inlet and at least one outlet, the sterilization chamber being in fluid communication with the suction opening through the at least one inlet; and a first suction nozzle sterilization unit disposed in the sterilization chamber to sterilize the air drawn into the sterilization chamber;

wherein the air drawn into the sterilization chamber revolves while moving from the at least one inlet to the at least one outlet.

2. The nozzle of claim 1, wherein the sterilization chamber has a cylindrical shape.

3. The nozzle of claim 2, further comprising a guide channel to guide the air drawn in through the suction opening, into the at least one inlet.

4. The nozzle of claim 3, wherein the guide channel is disposed in a tangential direction with respect to the sterilization chamber.

5. The nozzle of claim 2, wherein the at least one inlet and the at least one outlet are spaced apart from each other in a central axis direction of the sterilization chamber.

6. The nozzle of claim 1, wherein the sterilization chamber comprises:

a first sterilization chamber having a first inlet and a first outlet, the first sterilization chamber being in fluid communication with the suction opening through the first inlet; and a second sterilization chamber having a second inlet and a second outlet, the second sterilization chamber being in fluid communication with the suction opening through the second inlet.

7. The nozzle of claim 6, wherein the first and the second sterilization chambers are in the form of a cylinder, and have the same central axis.

8. The nozzle of claim 7, further comprising:

a first guide channel to guide the air drawn in through the suction opening, into the first inlet; and a second guide channel to guide the air drawn in through the suction opening, into the second inlet, wherein the first and the second guide channels are disposed in a tangential direction with respect to the first and the second sterilization chambers in the form of the cylinder.

9. The nozzle of claim 6, wherein the first inlet and the first outlet are spaced apart from each other in a central axis direction of the first sterilization chamber and the second inlet and the second outlet are spaced apart from each other in a central axis direction of the second sterilization chamber.

10. The nozzle of claim 9, wherein the first and the second outlets are in fluid communication with each other.

11. The nozzle of claim 2, wherein the first suction nozzle sterilization unit is disposed in a central part of the sterilization chamber.

12. The nozzle of claim 11, wherein the first suction nozzle sterilization unit has a cylindrical shape and is extended along a central axis of the sterilization chamber.

13. The nozzle of claim 2, wherein the first suction nozzle sterilization unit is disposed adjacent to a chamber wall forming the sterilization chamber.

14. The nozzle of claim 13, wherein the chamber wall has a plurality of mounting grooves projected outside from the chamber wall and extended in a width direction of the suction nozzle, and a plurality of sterilization units is mounted in the plurality of mounting grooves, respectively.

15. The nozzle of claim 14, wherein the plurality of mounting grooves is disposed at regular intervals.

16. The nozzle of claim 13, wherein the first suction nozzle sterilization unit has a ring shape, and is disposed on the chamber wall.

17. The nozzle of claim 16, wherein the first suction nozzle sterilization unit comprises a plurality of sterilization units and the plurality of sterilization units are disposed at regular intervals along a width direction of the suction nozzle.

18. The nozzle of claim 1, wherein a second suction nozzle sterilization unit is additionally disposed in a bottom casing of the suction nozzle.

19. The nozzle of claim 1, further comprising a drum brush to separate a dirt or dust from the surface to be cleaned, the drum brush having furs on which an antimicrobial is coated.

20. The nozzle of claim 19, wherein the antimicrobial comprises a nano-silver.

21. The nozzle of claim 1, wherein the first suction nozzle sterilization unit comprises one of an ultraviolet lamp, a heater and an ozonizer.

22. The nozzle of claim 1, further comprising more than one transparent window capable of observing the sterilization chamber from the outside.

23. A vacuum cleaner comprising:

a main body to generate a suction force; and a suction nozzle to draw in a dust or dirt from a surface to be cleaned by using the suction force, wherein the suction nozzle comprises:

a suction opening through which an air is drawn in along with the dirt or dust from the surface to be cleaned;

a sterilization chamber having at least one inlet and at least one outlet, the sterilization chamber being in fluid communication with the suction opening through the at least one inlet; and a first suction nozzle sterilization unit disposed in the sterilization chamber to sterilize the air drawn into the sterilization chamber, wherein the air drawn into the sterilization chamber revolves while moving from the at least one inlet to the at least one outlet.

24. A vacuum cleaner comprising:

the suction nozzle of claim 1 configured to draw in a dust or dirt from a surface to be cleaned; and a dust separating apparatus to separate the dust or dirt from the drawn-in air, wherein the dust separating apparatus comprises:

a cyclone chamber to separate the dust or dirt from an air drawn in from a surface to be cleaned, by using a centrifugal force; and a sterilization unit disposed in the cyclone chamber to sterilize the air drawn into the cyclone chamber, wherein the air drawn into the cyclone chamber revolves while moving from an inlet of the dust separating apparatus to an outlet of the dust separating apparatus.

25. A vacuum cleaner comprising:

a main body to generate a suction force, the main body comprising a dust separating apparatus;

a suction nozzle, connected to the main body, to draw in air along with dust or dirt from a surface to be cleaned, the suction nozzle comprising a sterilization chamber and a suction opening; and a sterilization unit disposed in at least one of the sterilization chamber and dust separating apparatus to sterilize air drawn into the vacuum cleaner by the suction nozzle, wherein the sterilization chamber has at least one inlet and at least one outlet, the sterilization chamber being in fluid communication with the suction opening through the at least one inlet.

* * * * *